US009739577B2

(12) United States Patent
Zhang et al.

(10) Patent No.: US 9,739,577 B2
(45) Date of Patent: Aug. 22, 2017

(54) DEVICE FOR LAUNCHING FIREWORKS

(71) Applicant: LIVE~WIRE PYROTECHNICS LTD, Changsha (CN)

(72) Inventors: Fan Zhang, Changsha (CN); Michael Knox, Lothian (GB)

(73) Assignee: LIVE-WIRE PYROTECHNICS LTD, Changsha (CN)

( * ) Notice: Subject to any disclaimer, the term of this patent is extended or adjusted under 35 U.S.C. 154(b) by 0 days.

(21) Appl. No.: 15/068,705

(22) Filed: Mar. 14, 2016

(65) Prior Publication Data

US 2016/0195372 A1 Jul. 7, 2016

Related U.S. Application Data

(63) Continuation-in-part of application No. PCT/CN2014/086139, filed on Sep. 9, 2014.

(30) Foreign Application Priority Data

Sep. 13, 2013 (CN) ..... 2013 1 0418465

(51) Int. Cl.
*F42B 4/20* (2006.01)
*F42B 3/103* (2006.01)

(52) U.S. Cl.
CPC ..... *F42B 4/20* (2013.01); *F42B 3/103* (2013.01)

(58) Field of Classification Search
CPC ..... F42B 4/14; F42B 3/12–3/13; F42B 3/103; F42B 4/20
See application file for complete search history.

(56) References Cited

U.S. PATENT DOCUMENTS 5,272,981 A * 12/1993 Badura ..... F42B 5/155 102/334
6,763,764 B2 * 7/2004 Avetisian ..... F42B 3/103 102/202.14
7,757,607 B1 * 7/2010 Deye ..... F41A 19/63 102/206
8,100,043 B1 * 1/2012 Nance ..... F42B 3/103 102/202.12

* cited by examiner

*Primary Examiner* — Stephen M Johnson
*Assistant Examiner* — Joshua Semick
(74) *Attorney, Agent, or Firm* — Matthias Scholl, PC; Matthias Scholl

(57) ABSTRACT

A device for launching fireworks, the device includes: a plastic plug and a locking base. The plastic plug includes: a resistance heating wire, a slot for accommodating the resistance heating wire, two metal conductors, two plate-like electrodes, and an upper clamping structure. The locking base includes: a lower clamping structure, two spring electrodes, and a circuit connecting socket. The top of the plastic plug is provided with the slot for accommodating the resistance heating wire. The resistance heating wire is fixed in the slot for accommodating the resistance heating wire and two ends of the resistance heating wire are electronically connected with one ends of the two metal conductors. The other ends of the two metal conductors are respectively electronically connected with the two plate-like electrodes and fixed at a bottom of the plastic plug. The bottom of the plastic plug is provided with the upper clamping structure.

11 Claims, 5 Drawing Sheets

DEVICE FOR LAUNCHING FIREWORKS

CROSS-REFERENCE TO RELATED APPLICATIONS

This application is a continuation-in-part of International Patent Application No. PCT/CN2014/086139 with an international filing date of Sep. 09, 2014, designating the United States, now pending, and further claims priority benefits to Chinese Patent Application No. 201310418465.4 filed Sep. 13, 2013. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, and Cambridge, Mass. 02142.

BACKGROUND OF THE INVENTION

Field of the Invention

The invention relates to a device for launching fireworks.

Description of the Related Art

A device for launching single shot fireworks typically adopts an electric igniter that ignites a lifting charge. However, firing holes of the single shot fireworks are either too large or too small, the launching force of the lifting charge does not fully act on the projection of the fireworks and parts of the energy produced when the lifting charge is ignited leaks from the firing holes, all which results in a variable, and often insufficient launch height and imprecise launch angle. Although additional lifting charges can be added to solve this problem, this makes the product more dangerous. In addition, the assembly of the electric igniter and the launching device is laborious, and the fixation mode of the fireworks is time-consuming.

SUMMARY OF THE INVENTION

In view of the above-described problems, it is one objective of the invention to provide a device for launching fireworks. The device ensures the full energy of the lifting charge act on the projection of the firework, possesses higher safety, reliable and stable performance, convenient use, and is adapted to save the amount of the lifting charges.

To achieve the above objective, in accordance with one embodiment of the invention, there is provided a device for launching fireworks. The device comprises: a plastic plug and a locking base. The plastic plug comprises: a resistance heating wire, a slot for accommodating the resistance heating wire, two metal conductors, two plate-like electrodes, and an upper clamping structure. The locking base comprises: a lower clamping structure, two spring electrodes, and a circuit connecting socket. A top of the plastic plug is provided with the slot for accommodating the resistance heating wire. The resistance heating wire is fixed in the slot for accommodating the resistance heating wire and two ends of the resistance heating wire are electronically connected with one ends of the two metal conductors. The other ends of the two metal conductors are respectively electronically connected with the two plate-like electrodes and fixed at a bottom of the plastic plug. The bottom of the plastic plug is provided with the upper clamping structure. The locking base is provided with the lower clamping structure. The upper clamping structure and the lower clamping structure are clamped together to lock the plastic plug to the locking base. A top of the locking base is provided with the two spring electrodes, and the two spring electrodes are respectively aligned with the two plate-like electrodes of the plastic plug to form an electric connection. The circuit connecting socket is fixed on the locking base and electrically connected to the spring electrodes.

In a class of this embodiment, the top of the plastic plug is a concave structure having a rim part higher than a middle part; and the slot for accommodating the resistance heating wire is positioned at a bottom of the concave structure of the plastic plug.

In a class of this embodiment, the resistance heating wire is coated with a metal layer adapted to be soldered.

In a class of this embodiment, the resistance heating wire is coated with an anti-oxidation protective mask operating to fix the resistance heating wire onto the circuit board.

In a class of this embodiment, the plastic plug is provided with a locking slot; the locking base is provided with a locking lever, and the locking lever is locked in the locking slot.

In a class of this embodiment, the locking base is at least one in number, and the locking bases are integrated to form a unit.

In a class of this embodiment, the locking base is provided with multiple lower clamping structures having different diameters and independent from one another.

In a class of this embodiment, the resistance heating wire is in a coiled configuration having excellent electro-thermal conversion capability.

The resistance wire is fixed in place by coating an anti-oxidation protective mask, which can effectively avoid direct contact between the resistance wire and the lifting charge. The mask is very thin and easy to burn, bringing no influence to the ignition performance of the resistance wire. The anti-oxidation protective mask glues and fixes the resistance wire to the circuit board. The mask possesses structural property to withstand any abrasive contact from the lifting charge. The top of the plastic plug is in the concave structure having the rim higher than the middle part and the slot for accommodating the resistance heating wire is positioned at the bottom of the concave structure. Lifting charge filled into the bottom plug accumulates at the bottom of the concave structure to ensure a good contact with the resistance wire located in the center of the bottom of the concave structure. Meanwhile, the concave structure facilitates the bursting energy of the lifting charge to be concentrated and focused towards the middle thereby achieving greater height projection. The slot for accommodating the resistance heating wire of the plastic plug has a through slot leading to the bottom. The circuit board with the resistance heating wire and the metal conductors soldered thereon is placed into the slot for accommodating the resistance heating wire, where the resistance heating wire is positioned upwards and the two metal conductors are positioned downwards fixed into the through slot. The circuit board is fixed and the through slot is sealed by adhesive. The bottom of the metal conductors is soldered to the two plate-like electrodes, these electrodes face downwards. The bottom of the concave structure of the plastic plug is provided with structural ribs; these ribs improve the structural performance of the plastic plug together with the wall of the through slot. The upper clamping structure on the plastic plug corresponds to the lower clamping structure of the locking base. When loading, the plastic plug is clamped onto the locking base, the two spring electrodes on the locking base are pressed down to make reliable contact with the two plate-like electrodes of the plastic plug. At the same time, the spring locking lever on the locking base is sited in the locking slot of the plastic plug, thus preventing the plastic plug from being disengaged from the locking base by vibrations caused by launching other fireworks.

During the assembly, the plastic plug pre-installed with the resistance heating wire is inserted into a firework tube and is fixed by means of glue, adhesives, staples or nails. Then lifting charge, paper disk with holes, firework effect components are filled in and a paper disk is used to seal.

In use, the locking base equipped with the spring electrodes and the circuit connecting socket is positioned onto a board at a variety of different angles. The spring electrodes on the locking base are connected to a firing system via a cable with corresponding plugs. The single-shot firework equipped with the plastic plug is clamped and fixed to the lower clamping structure of the locking base along the upper clamping structure. The spring electrodes on the locking base are compressed to make reliable contact with the plate-like electrodes on the plastic plug. The resistance heating wire is connected to the firing system along the metal electrodes, the plate-like electrodes, the spring electrodes, the circuit connecting socket and the cable. During launching of the single shot firework, the firing system conducts current to the resistance heating wire which instantly heat up to ignite the lifting charge by direct contact, thereby launching the single shot firework.

Advantages of the device for launching fireworks according to embodiments of the invention are summarized as follows:

Compared with conventional single shot fireworks, the cavity for the lifting charge is completely sealed, and the concave structure of the plastic bottom plug creates maximum energy from the lifting charge to project the firework effects. Thus, the same projecting height can be achieved by using half of the lifting charge, which reduces the product weight, reduces smoke, reduces the shooting noise, increases safety, and has stable and reliable performance. The pre-installed resistance heating wire has no dangerous components which can misfire by friction or impact, so that safety is ensured in production, storage, transportation, and use. The locking base can be used repeatedly, thus increasing the utilization of resources and reducing the usage cost. The device of the invention is simple and fast to assemble and operate. Precise-angle assembly of multiple single-shot fireworks can be achieved simply by adjusting the angle of the flat board where the locking base is fixed. Reliable electrical connection can be achieved by clamping and fixing the single shot fireworks on the locking base which significantly saves labor.

BRIEF DESCRIPTION OF THE DRAWINGS

The invention is described hereinbelow with reference to the accompanying drawings, in which.

DETAILED DESCRIPTION OF THE EMBODIMENTS

For further illustrating the invention, experiments detailing a device for launching fireworks are described below. It should be noted that the following examples are intended to describe and not to limit the invention.

Figure 1:
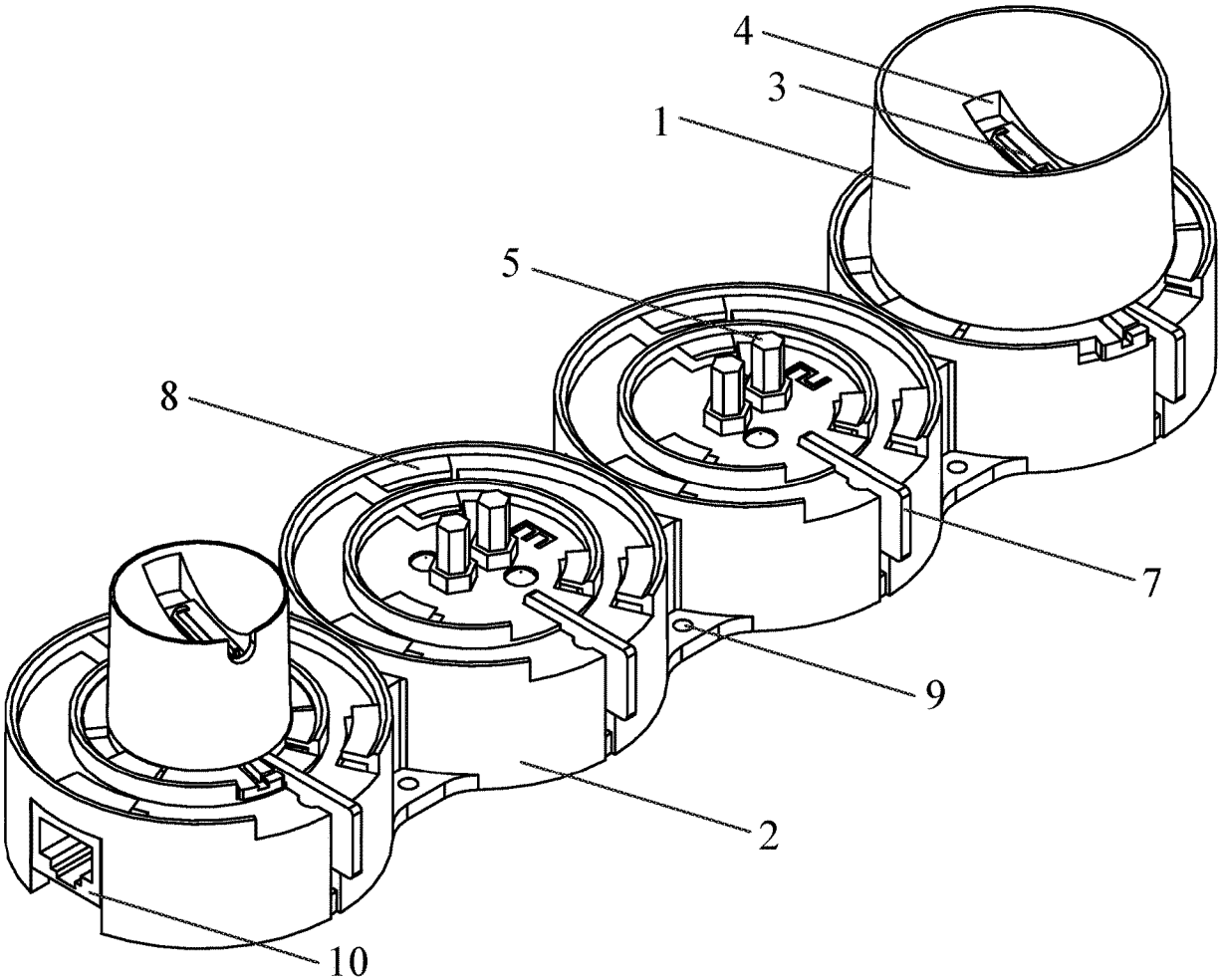
FIG. 1 is a structural diagram of a device for launching fireworks in accordance with one embodiment of the invention.
Figure 2:
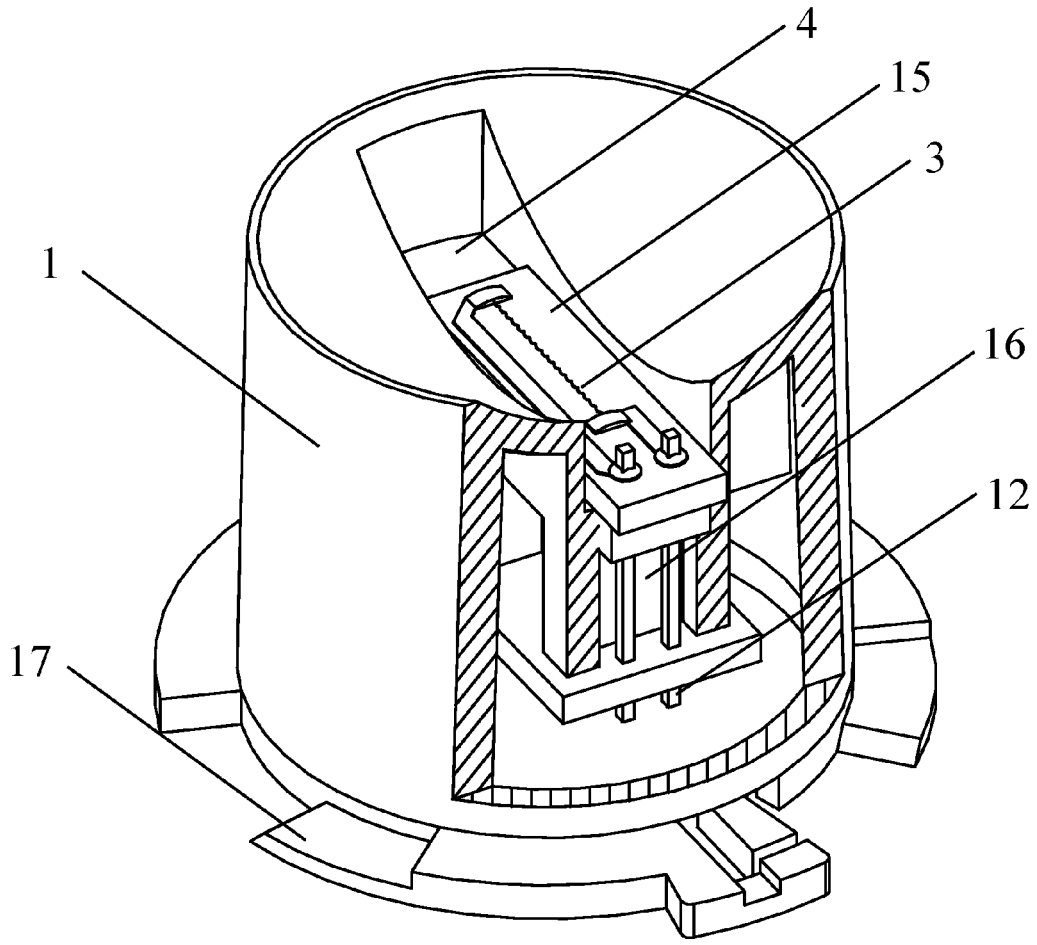
FIG. 2 is a structural diagram of a plastic plug showing a cross section thereof according to one embodiment of the present invention.
Figure 3:
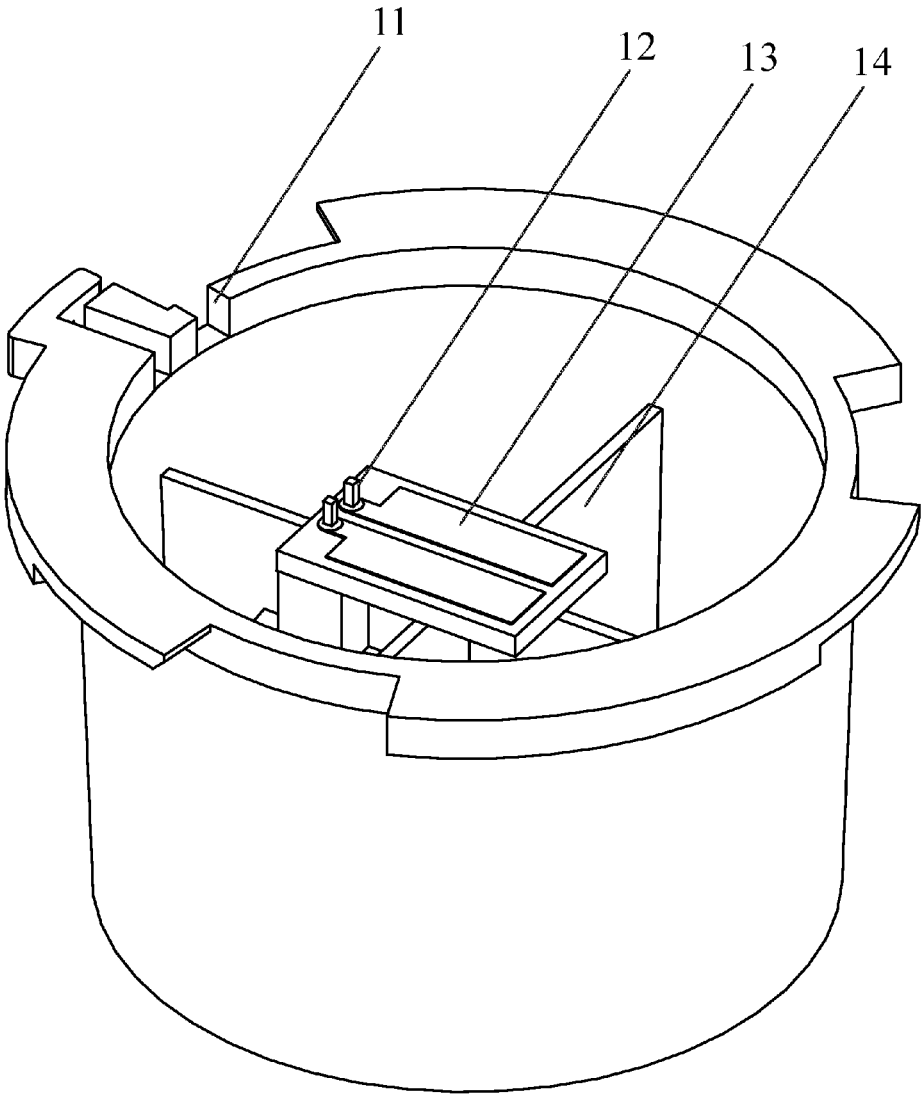
FIG. 3 is a structure diagram of a bottom of a plastic plug according to one embodiment of the present invention.

As shown in FIGS. 1-3, a top of a plastic plug 1 is a concave structure having a rim higher than a middle part thereof, and a bottom of the concave structure is provided with a slot 4 for accommodating a resistance heating wire 3. A bottom part of the plastic plug 1 is provided with a through slot 16 passing through the slot 4 for accommodating the resistance heating wire and a bottom of the plastic plug 1. In this embodiment, a circuit board is used as a circuit board 15, two pins are used as metal conductors 12, and a circuit board provided with two separate large-area bonding pads is used as plate-like electrodes 13. Two ends of the resistance heating wire 3 are respectively electrically connected to the two pins 12 and fixed onto the circuit board 15. The resistance heating wire 3 is in a coiled configuration having excellent electro-thermal conversion capability. The resistance heating wire 3 is coated with a metal layer adapted to be soldered, and is also coated with an anti-oxidation protective mask operating to fix the resistance heating wire 3 onto the circuit board 15. The circuit board 15 is fixed in the slot 4 for accommodating the resistance heating wire by an adhesive and the resistance heating wire 3 faces upwards. The two pins 12 faces downwards and are positioned in the through slot 16. In a lower portion of the through slot 16, the two plate-like electrodes 13 are respectively electrically connected to the two pins 12. An edge at the bottom of the plastic plug 1 is provided with an upper clamping structure 17. The bottom of the plastic plug 1 is provided with a locking slot 11, and the bottom of the plastic plug 1 is provided with a structural rib 14.

As shown in FIG. 2-3, the resistance heating wire 3 serves as the ignition method, two ends of the resistance heating wire 3 and the two pins 12 are electronically connected respectively and are soldered onto the circuit board 15. The resistance heating wire 3 is in a coiled configuration having excellent electro-thermal conversion capability. For the resistance heating wire 3 having poor soldering performance, reliability is improved by electroplating a coating of metal adapted to be soldered, and the circuit board 15 where the resistance heating wire 3 is soldered is further coated with a nitrocellulose varnish to protect the resistance heating wire 3. The top of the plastic plug 1 is the concave structure having the rim higher than middle part, and the slot 4 for accommodating the resistance heating wire is located at a lowest part in the middle of the concave structure. Walls of the through slot 16 together with the structural rib 14 are used to improve the structural performance of the plastic plug 1.

The circuit board 15 where the resistance heating wire 3 and the pins 12 are soldered is placed into the slot 4 for accommodating resistance heating wire of the plastic plug 1 to allow both the resistance heating wire 3 and the two pins 12 to be fixed in the through slot 6 with the resistance heating wire 3 facing upwards and the two pins 12 facing downwards. The circuit board 15 is fixed in the slot for accommodating the resistance heating wire 4 via glue.

In the bottom of the through slot 16, a circuit board provided with two plate-like electrodes 13 is soldered to the other ends of the two pins 12, and the plate-like electrodes 13 faces downwards.

Figure 4:
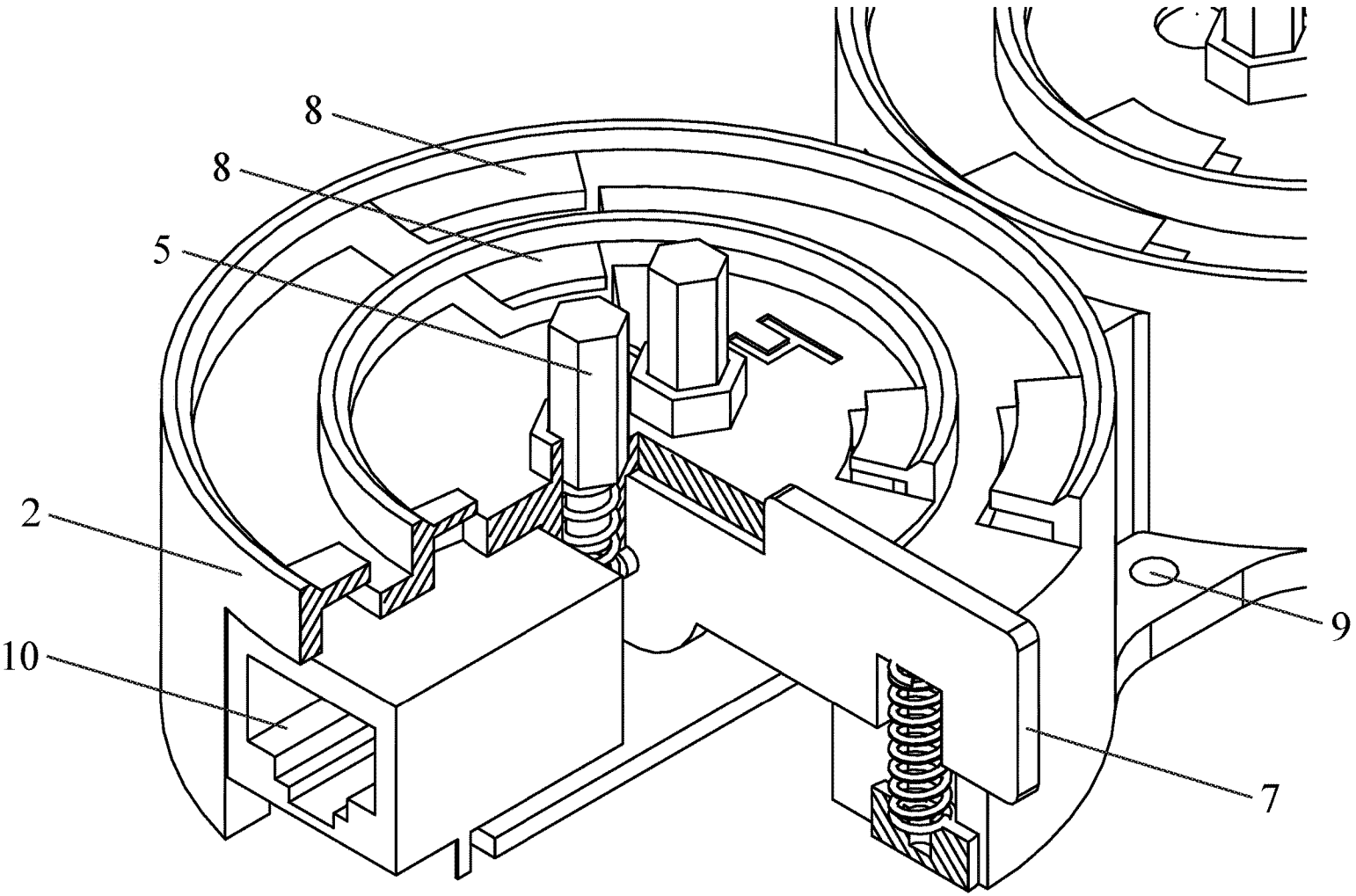
FIG. 4 is a structure diagram of a part of a locking base according to one embodiment of the present invention.

As shown in FIG. 4, an upper portion of the locking base 2 is provided with multiple lower clamping structures 8 having different diameters and independent from one another. The lower clamping structures 8 are correspondingly connected to the upper clamping structure 7 of the plastic plug 1. The locking base 2 is provided with two spring electrodes 5. In this embodiment, the spring electrodes 5 are formed by soldering a copper column on a spring, a part of the copper column in contact with the plate-like electrodes 13 of the plastic plug 1 is optionally gold-plated or provided with a stainless steel cap to prevent oxidization. The spring is soldered onto a circuit board. In this embodiment, four locking bases 4 are joined up in a line to form a whole. Two sides of each locking base 4 are provided with screw fixing holes 9. In this embodiment, two RJ45 network sockets serving as circuit connecting socket 10 are soldered onto the circuit board, which are respectively located on sides of two ends of the locking base 2, and the locking base 2 is provided with a spring locking lever 7.

Figure 5:
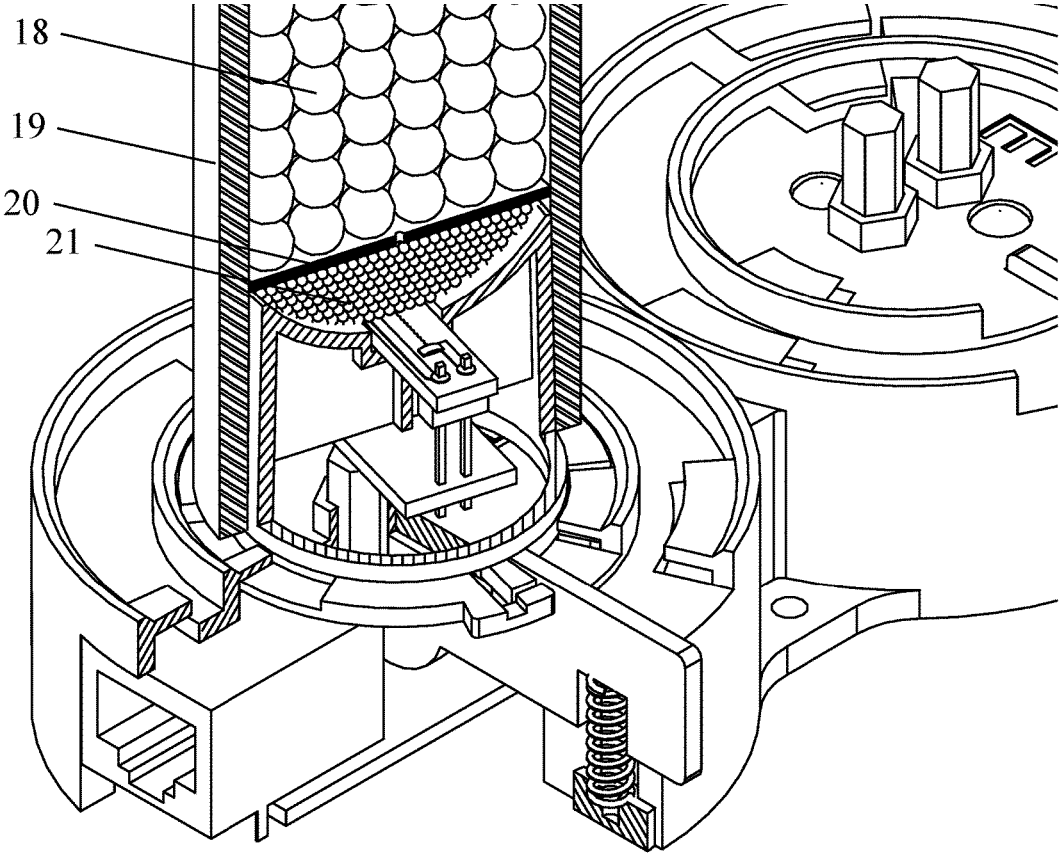
FIG. 5 is a structure diagram showing a plastic plug and a locking base assembled together according to one embodiment of the present invention.

As shown in FIG. 5, when a single-shot firework is assembled, the plastic plug 1 is inserted into a tube 19 of the single-shot firework, the tube 19 is fixed with the plastic plug 1 by adhesives or nails. A lifting charge 21 is filled in from the other end of the tube 19 and falls into the concave structure in the top of the plastic plug 1, so that the lifting charge is in good contact with the resistance heating wire 3. Then a paper disk 20 with holes, effect components 18, and sealed paper disk are sequentially filled in.

In use, the locking base 2 is first fixed on a board at different angles along the screw fixing holes 9, which is inserted into the RJ45 socket 10 through a CATS cable. The spring electrodes 5 on the locking base is led out and connected to any firing system. The single-shot firework equipped with the plastic plug 1 is clamped and fixed to the lower clamping structure 18 of the locking base 2 along the upper clamping structure 17 of the plastic bottom plug 1. The locking lever 7 on the locking base 2 is secured within the locking slot 11 of the plastic plug 1. The spring electrodes 5 on the locking base 2 are pressed to make reliable contact with the plate-like electrodes 13 on the plastic plug 1. The circuit of the resistance heating wire 3 is connected to the firing system along the metal conductors 12, the plate-like electrodes 13, the spring electrodes 5, the circuit connecting socket 20 and the cable. During ignition of the firework, the firing system conducts current into the resistance heating wire 3 and instantly heats up to ignite by direct contact with the lifting charge 21, thereby launching the single-shot firework.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A device for launching fireworks, the fireworks having a lifting charge, the device comprising:

a) a plastic plug, the plastic plug comprising: a first top, a bottom, a resistance heating wire comprising two ends, a slot, two metal conductors, two plate-like electrodes, a circuit board, and an upper clamping structure; and b) a locking base, the locking base comprising: a second top, a lower clamping structure, two spring electrodes, and a circuit connecting socket; wherein:

the resistance heating wire is electrically connected to and fixed on the circuit board;

the slot is disposed on the first top;

the resistance heating wire and the circuit board are disposed inside the slot;

the circuit board is fixed on the slot;

the two ends of the resistance heating wire are respectively electrically connected with the two metal conductors; the two metal conductors are respectively electrically connected with the two plate-like electrodes and fixed at the bottom of the plastic plug; the bottom of the plastic plug is provided with the upper clamping structure;

the locking base is provided with the lower clamping structure; the upper clamping structure and the lower clamping structure are clamped together to lock the plastic plug to the locking base; the second top of the locking base is provided with the two spring electrodes, and the two spring electrodes are respectively aligned with the two plate-like electrodes of the plastic plug to form electric connection; and the circuit connecting socket is fixed on the locking base and electrically connected to the two spring electrodes;

the first top is adapted to accommodate the lifting charge, wherein the resistance heating wire contacts the lifting charge; and the resistance heating wire is adapted to be electrified via the circuit board and to ignite the lifting charge for launching the fireworks.

2. The device of claim 1, wherein the top of the plastic plug is a concave structure having a rim part and a middle part; the rim part is higher than the middle part; and the slot is positioned at the middle part.

3. The device of claim 1, wherein the resistance heating wire is coated with a metal layer.

4. The device of claim 2, wherein the resistance heating wire is coated with a metal layer.

5. The device of claim 1, wherein the resistance heating wire is coated with an anti-oxidation protective mask operating to fix the resistance heating wire onto the circuit board.

6. The device of claim 2, wherein the resistance heating wire is coated with an anti-oxidation protective mask operating to fix the resistance heating wire onto the circuit board.

7. The device of claim 1, wherein the plastic plug is provided with a locking slot; the locking base is provided with a locking lever, and the locking lever is locked in the locking slot.

8. The device of claim 2, wherein the plastic plug is provided with a locking slot; the locking base is provided with a locking lever, and the locking lever is locked in the locking slot.

9. The device of claim 1, wherein the locking base is at least two in number, and the locking base is integrated to form a unit.

10. The device of claim 1, wherein the locking base is provided with multiple lower clamping structures having different diameters and independent from one another.

11. The device of claim 1, wherein the resistance heating wire is in a coiled configuration.

* * * * *